US007621626B2

(12) United States Patent
Umeda

(10) Patent No.: US 7,621,626 B2
(45) Date of Patent: Nov. 24, 2009

(54) INKJET RECORDING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 557 days.

(21) Appl. No.: 11/460,469

(22) Filed: Jul. 27, 2006

(65) Prior Publication Data

US 2007/0024681 A1 Feb. 1, 2007

(30) Foreign Application Priority Data

Jul. 27, 2005 (JP) ..... 2005-217697

(51) Int. Cl.
*B41J 2/175* (2006.01)

(52) U.S. Cl. ..... 347/85; 347/84; 347/86; 347/28; 347/29; 347/30; 347/34; 347/35; 347/7

(58) Field of Classification Search ..... 347/84, 347/85, 86, 7, 28, 30, 34, 35
See application file for complete search history.

(56) References Cited

U.S. PATENT DOCUMENTS 4,368,478 A * 1/1983 Koto ..... 347/86
5,729,256 A * 3/1998 Yamanaka et al. ..... 347/7
2004/0061748 A1* 4/2004 Kuwabara et al. ..... 347/85

FOREIGN PATENT DOCUMENTS

JP 2004 202797 7/2004
JP 2005 22167 1/2005

* cited by examiner

*Primary Examiner*—Stephen D Meier
*Assistant Examiner*—Laura E Martin
(74) *Attorney, Agent, or Firm*—Baker Botts L.L.P.

(57) ABSTRACT

An inkjet recording apparatus is provided with a recording head, a main tank, a tube, a transfer device, a transfer amount determination device and a driving device. The recording head includes a sub tank for storing ink and an ejection nozzle. The main tank stores ink to be supplied to an inside of the sub tank. The tube connects the sub tank and the main tank. The transfer device transfers ink existing in the tube. The transfer amount determination device determines at least one transfer amount of a mixture of the ink and air transferred through the tube while air moves from a first detection position to a second detection position of the tube. The driving device controls driving of the transfer device in accordance with the at least one transfer amount determined by the transfer amount determination device.

19 Claims, 10 Drawing Sheets

DRIVINGLY CONNECTED STATE

DRIVINGLY DISCONNECTED STATE

FIG.9

CORRESPONDING SETTING RANK TABLE

<SETTING OF TUBE INNER DIAMETER AND PUMP LIQUID-TRANSFER AMOUNT>

| | TUBE INNER DIAMETER | PUMP LIQUID-TRANSFER AMOUNT | |
|---|---|---|---|
| LARGE | A1 | Q1 | LARGE |
| ↑ | A2 | Q2 | ↑ |
| | A3 | Q3 | |
| | A4 | Q4 | |
| SMALL | A5 | Q5 | SMALL |

FIG.10

CORRESPONDING SETTING RANK TABLE

<SETTING OF TUBE FLOW PATH RESISTANCE AND PUMP LIQUID-TRANSFER PRESSURE>

| | TUBE FLOW PATH RESISTANCE | PUMP LIQUID-TRANSFER PRESSURE | |
|---|---|---|---|
| HIGH | H1 | P1 | HIGH |
| ↑ | H2 | P2 | ↑ |
| | H3 | P3 | |
| | H4 | P4 | |
| LOW | H5 | P5 | LOW |

INKJET RECORDING APPARATUS

CROSS-REFERENCE TO RELATED APPLICATIONS

This application claims the benefit of Japanese Patent Application No. 2005-217697 filed Jul. 27, 2005 in the Japanese Patent Office, the disclosure of which is incorporated herein by reference.

BACKGROUND

The present invention relates to a technique for performing transfer of at least one of ink and air existing at least in a tube, which connects an ink tank and a recording head in an inkjet recording apparatus, regardless of variations in dimension corresponding values of the tube (for example, a diameter of the tube, a length of the tube, an inner volume of the tube, a flow path resistance in the tube (a pressure loss)), in a manner in accordance with the variations in the dimension corresponding values of the tube.

There is a known inkjet recording apparatus provided with an ink supply system of tube supply type. Specifically, such an inkjet recording apparatus includes a carriage and a main tank. On the carriage a recording head and a sub tank are mounted. The recording head ejects ink from an ejection nozzle to perform recording on a recording medium. The sub tank stores ink to be supplied to the recording head. The main tank stores ink to be supplied to the sub tank. In the inkjet recording apparatus, when the ink in the sub tank decreases, the ink in the main tank is supplied to the sub tank through a tube.

In the above inkjet recording apparatus, a viscosity of ink accumulated in the ejection nozzle and a tube in the recording head gradually increases. Therefore, there has been devised an inkjet recording apparatus of this type that periodically performs a purge operation in order to expel ink accumulated in the ejection nozzle and the tube of the recording head.

SUMMARY

The above described inkjet recording apparatus, however, involves the following problems. Specifically, the tube has variations in dimension corresponding values of the tube (for example, a diameter of the tube, a length of the tube, an inner volume of the tube, a flow path resistance (a pressure loss) in the tube) at the time of manufacturing thereof. Accordingly, the apparatus may be configured to discard an amount of ink or air-containing ink larger than an amount corresponding to an inner volume of the tube as originally designed at, for example, an initial operation (at the time of turning on the inkjet recording apparatus for the first time). This discarding is performed in spite of the fact that an inner volume of the tube may be sometimes smaller than the inner volume of the tube as originally designed. This is to surely prevent ink or air-containing ink with an increased viscosity from remaining in the tube.

The diameter (the inner diameter) of the tube may also be larger than a diameter as originally designed. In this case, a flow path resistance in the tube (in other words, a flow path resistance (a pressure loss) when ink flows in the tube) will be reduced compared with a case of the diameter of the tube being as originally designed. However, during a purge operation to recover a discharge ability of the ejection nozzle, ink may be discharged from the ejection nozzle at a purge pressure based on an assumption of a larger flow path resistance in the tube than a flow path resistance in the tube in a case of the diameter of the tube being as originally designed. This discharging will be performed in order to ensure a sufficient recovery of the discharge ability of the ejection nozzle. Accordingly, an excessive amount of ink will be discharged (discarded) also in this case.

One aspect of the present invention may provide a technique for driving a transfer device that transfers ink existing in a tube, which connects an ink tank and a recording head in an inkjet recording apparatus, in a manner in accordance with dimension corresponding values of the tube.

In the one aspect of the present invention, there is provided an inkjet recording apparatus which comprises a recording head, a main tank, a tube, a transfer device, a transfer amount determination device and a driving device.

The recording head includes a sub tank for storing ink and an ejection nozzle. The recording head selectively ejects the ink in the sub tank from the ejection nozzle to record an image on a recording medium. The main tank stores ink to be supplied to an inside of the sub tank. The tube connects the sub tank and the main tank. The transfer device transfers ink existing in the tube. The transfer amount determination device determines at least one transfer amount of a mixture of the ink and air transferred through the tube while air moves from a first detection position to a second detection position of the tube. The driving device controls driving of the transfer device in accordance with the at least one transfer amount determined by the transfer amount determination device.

The transfer amount determined by the transfer amount determination device corresponds to a volume inside the tube (a dimension corresponding value) between the two detection positions. Accordingly, the driving device may control driving of the transfer device in accordance with the dimension corresponding value of the tube in the present invention.

According to the present invention, it may be possible to reduce a wasteful amount of ink to be expelled to an outside of the tube during an operation such as an initial operation. It may also be possible to reduce a wasteful amount of ink to be discharged from the ejection nozzle to recover a discharge ability of the ejection nozzle in order to prevent ink or air-containing ink with an increased viscosity from remaining in the tube. These may be accomplished by achieving control of driving of the transfer device in accordance with, for example, a dimension corresponding value of the tube.

BRIEF DESCRIPTION OF THE DRAWINGS

A preferred embodiment of the present invention will be described hereinafter with reference to the drawings, in which:

FIG. 9 is a view showing a corresponding setting rank table.

FIG. 10 is a view showing a corresponding setting rank table.

DETAILED DESCRIPTION OF THE PREFERRED EMBODIMENT

Overall Structure of Inkjet Recording Apparatus 1

An inkjet recording apparatus 1 is a so-called multifunction device (MFD: Multi Function Device) including a printer function, a copier function, a scanner function, a facsimile function and others. A sheet, such as a sheet of paper or a plastic film, is used as a recording medium. In the inkjet recording apparatus 1, black-and-white image recording is performed in the facsimile function, while color image recording and black-and-white image recording can be performed in the printer function and the copier function.

Figure 1:
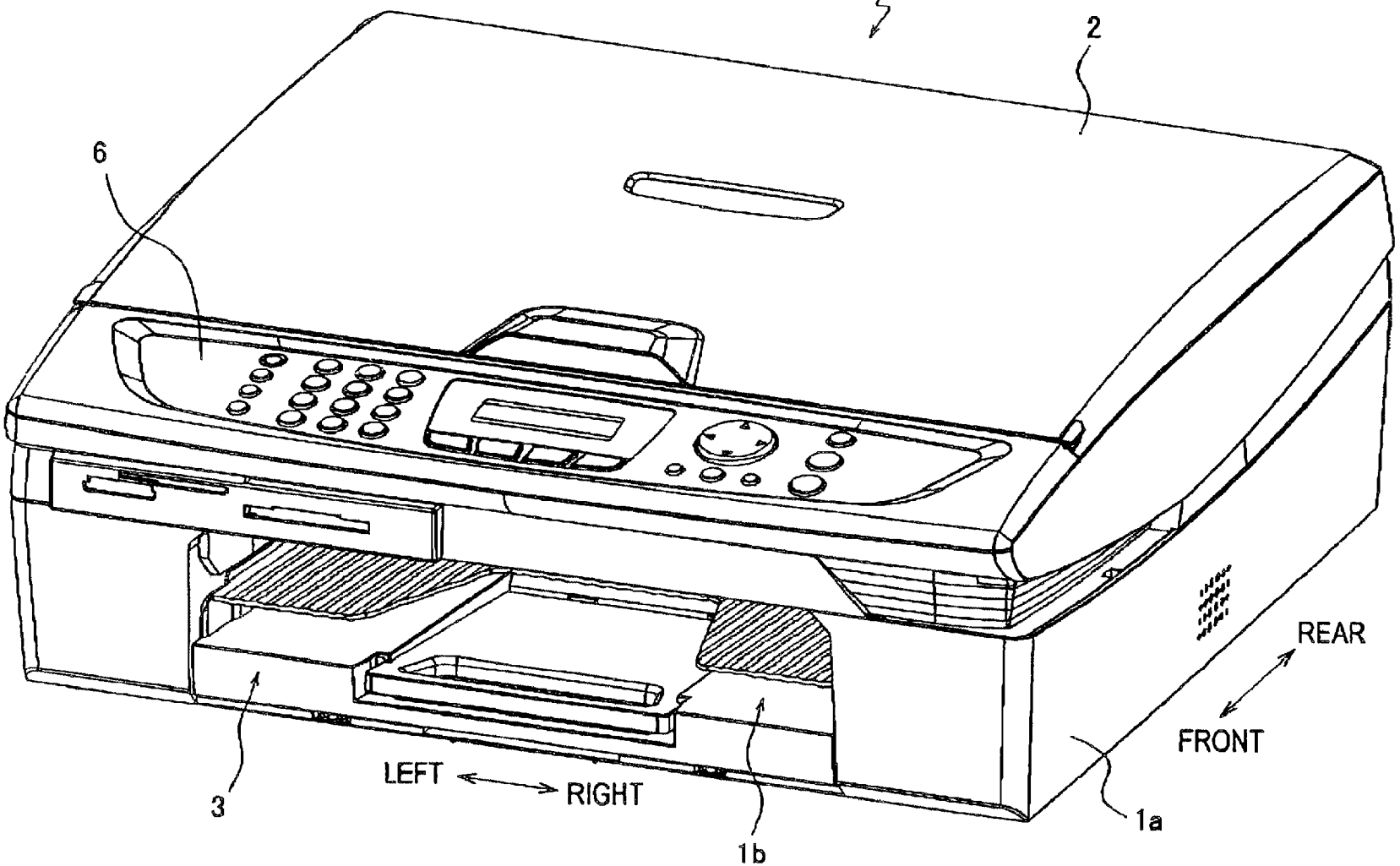
FIG. 1 is a perspective view showing an appearance of a preferred inkjet recording apparatus to which the present invention is applied.
Figure 2:
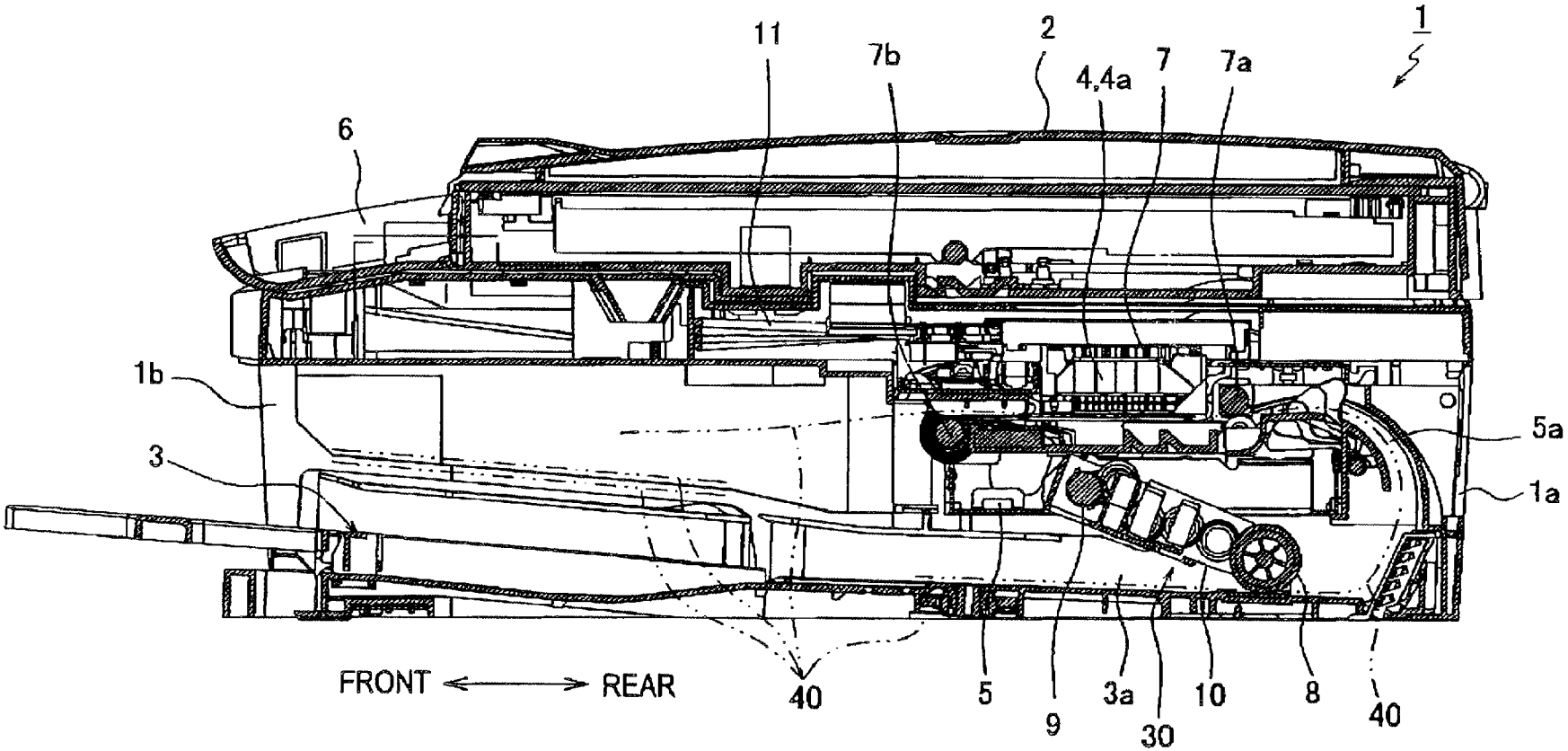
FIG. 2 is a cross-sectional view of the inkjet recording apparatus.

As shown in FIG. 1 and FIG. 2, the inkjet recording apparatus 1 includes a scanner 2 over a case 1*a* and a recording unit 7 that performs recording (i.e., image formation) on a recording sheet 40 in each of the above functions under the scanner 2 (in an upper part inside the case 1*a*).

As shown FIG. 2, a sheet feeder 30 is disposed in a lower part inside the case 1*a*. A box-shaped metal frame 5 is disposed above the sheet feeder 30 in a rear part inside the case 1*a*. The frame 5, which has a substantially rectangular configuration with a larger length in a right and left direction, is fixed inside the case 1*a*.

The recording unit 7 disposed in an upper part inside the frame 5 includes a carriage 4*a* and other mechanisms. The carriage 4*a* is reciprocable in a right and left direction (in a main scanning direction), and a recording head 4 for performing printer image recording is mounted on the carriage 4*a*. The carriage 4*a* is controlled by a control unit 110 (not shown in FIG. 2; see FIG. 6), including a CPU, to reciprocate in a right and left direction, thereby to make the recording head 4 scan. The recording head 4 discharges ink from an ejection nozzle 14*a* (not shown in FIG. 2; see FIG. 3A) during the scanning to record an image on the recording sheet 40 which is statically located under the recording head 4.

A maintenance unit (not shown) is mounted at a position corresponding to a waiting position of the carriage 4*a* in the recording unit 7. The maintenance unit performs various maintenance operations, such as a wiping operation for wiping a nozzle surface of the recording head 4 with a blade or the like, a purge operation and a flushing operation for forcibly removing dust, air and solidified ink from inside the ejection nozzle 14*a*.

Four ink cartridges 13 (not shown in FIG. 2; see FIG. 3A) containing four colors (black, cyan, magenta and yellow) of inks, respectively, for performing full-color recording are housed in a front part inside the case 1*a*. To replenish ink, each of the ink cartridges 13 which are configured to be attachable/detachable is replaced with a new one.

The inks contained in the respective ink cartridges 13 are designed to be supplied to the respective recording heads 4 through four ink supply tubes 11 which connect the respective ink cartridges 13 and the respective recording heads 4. These ink supply tubes 11 are held so as to follow the reciprocation of the carriage 4*a*.

A conveying path 5*a* for guiding the recording sheet 40 from behind the sheet feeder 30 to the recording unit 7 is formed in a rear part of the frame 5. The recording unit 7 includes a conveyer roller 7*a* located adjacent to an exit of the conveying path 5*a* and a discharge roller 7*b* located where the recording sheet with a recorded image thereon is discharged. The conveyer roller 7*a* is rotated by receiving a rotational driving force of a sheet conveyance motor 123 (not shown in FIG. 2; see FIG. 6).

The sheet feeder 30 includes a sheet feed cassette 3 which is inserted from an opening 1*b* of the case 1*a* and is set. The sheet feed cassette 3 includes a sheet container 3*a* for containing a plurality of recording sheets 40 in a stacked manner. When the sheet feed cassette 3 is inserted into the case 1*a*, the recording sheets 40 in the sheet container 3*a* are positioned in a rear part inside the case 1*a*.

An uppermost sheet of the stacked recording sheets 40 in the sheet container 3*a* is conveyed by a rotation of a sheet feed roller 8 through the conveying path 5*a* to the recording unit 7. The sheet feed roller 8 is rotatably held at one end of a longitudinal arm 10 which is axially supported by a drive shaft 9. When the drive shaft 9 is rotated by the rotational driving force of a sheet feed motor 122 (not shown in FIG. 2; see FIG. 6), the rotation of the drive shaft 9 is transmitted thereby to rotate the sheet feed roller 8.

An operation panel 6, including various operation buttons and a liquid crystal display, is provided in a front upper part of the inkjet recording apparatus 1. A user may select one mode from among a printer mode, a copy mode, a scanner mode and a facsimile mode in the inkjet recording apparatus 1; perform setting with respect to various setting items in each mode; input necessary information such as a facsimile number; and confirm an operating state, a communication history, and others. It may be possible to perform, by the user's operation of the operation panel 6, a discharge of ink through the ejection nozzle 14*a* (a purge operation) at a relatively high pressure in order to recover a discharge ability of the ejection nozzle 14*a*.

Explanation of Ink Supply Mechanism

Figures 3A, 3B:
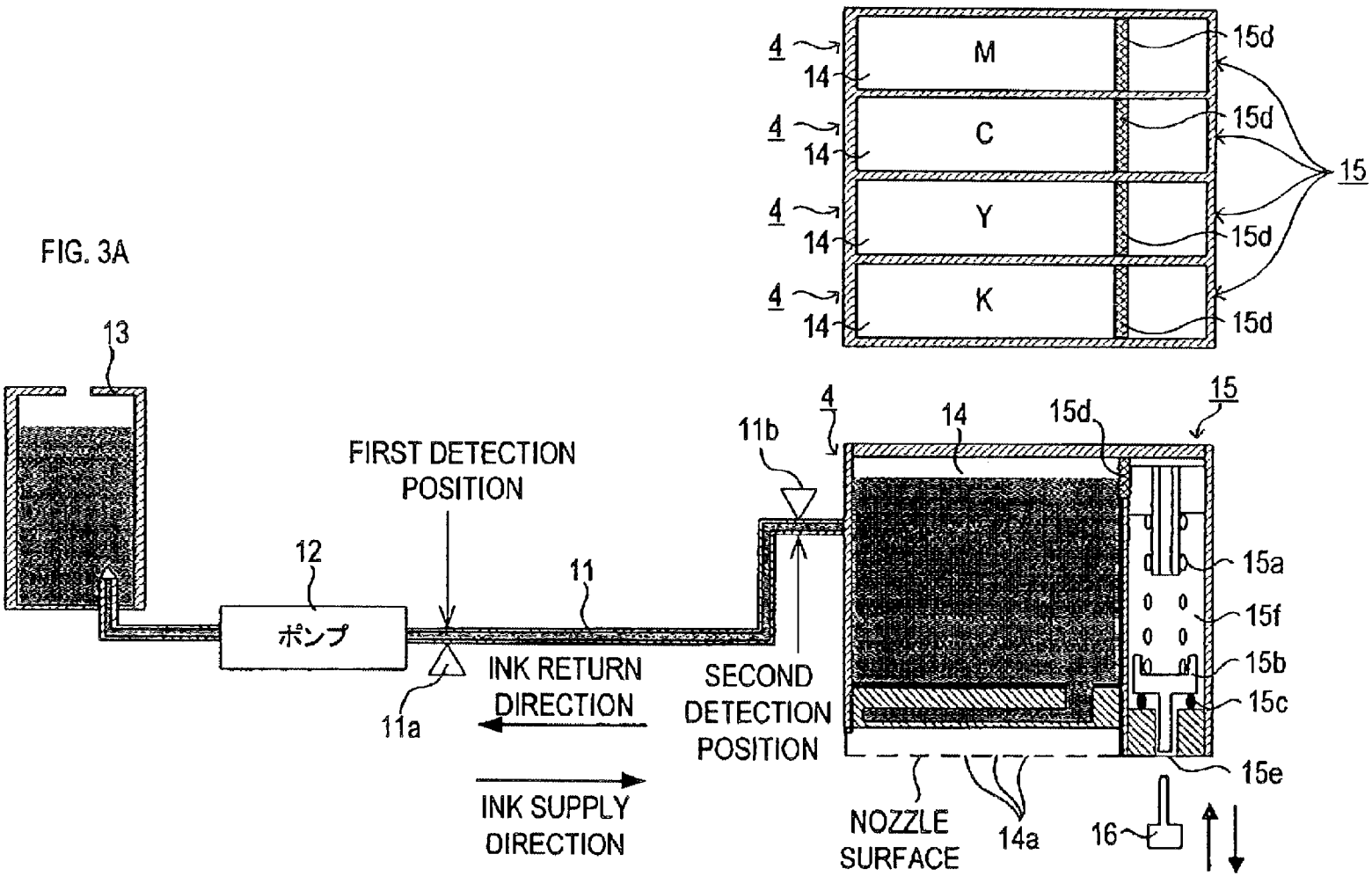
FIG. 3A is an explanatory view schematically showing a side cross section of an ink supply mechanism of the inkjet recording apparatus.
FIG. 3B is an explanatory view schematically showing a cross section of a recording head seen from above.

An ink supply mechanism is a mechanism for supplying four colors of ink, i.e., magenta (M), cyan (C), yellow (Y) and black (K), from the respective ink cartridges 13 to four corresponding recording heads 4 (see FIG. 3B) provided on the carriage 4*a* of the recording unit 7. As shown in FIG. 3A, each ink cartridge 13 for each color of ink and each sub tank 14 provided in each corresponding recording head 4 communicate with each other through an ink supply tube 11 and a pump 12 provided in the middle along the ink supply tube 11. In other words, four ink supply tubes 11 and four pumps 12 are correspondingly provided to the respective four recording heads 4, respectively. In the present embodiment, each of the pumps 12 is provided in a vicinity of an end of each of the ink supply tubes 11 on a side of each of the ink cartridges 13.

An air detector 11*a* capable of detecting air in the ink supply tube 11 is provided to the ink supply tube 11 on a side of the sub tank 14 of and in a vicinity of the pump 12 (a first detection position). An air detector 11*b* capable of detecting air in the ink supply tube 11 is provided to the ink supply tube 11 in a vicinity of the sub tank 14 (a second detection position). The first detection position is preferably as close to the pump 12 (and thus, the ink cartridge 13) as possible and the second detection position is preferably as close to the sub tank 14 as possible, in order to specify an internal volume of the ink supply tube 11 more accurately. The air detector 11*a* and the air detector 11*b* are electrically connected to a later-described control unit 110. The air detector 11*a* and the air detector 11*b* may be an optical detector, in which detection of existence of air is performed by detecting a state of light transmitting through the ink supply tube 11, or may be an electrical resistance detector, in which an electrical resistance value is continuously detected with respect to a portion of the ink supply tube 11, to detect existence of air based on changes in the electrical resistance value. However, detailed explanations thereof are omitted here since both are according to the known prior art.

The recording head 4 includes the sub tank 14 for reserving ink to be discharged from the ejection nozzle 14*a* provided in the nozzle surface in a lower part of the recording head 4, and a valve unit 15 for opening or closing the sub tank 14 to the atmosphere, corresponding to each color of ink. The sub tank 14 and the valve unit 15 communicate with each other through an air permeable membrane 15*d* as a selective permeable membrane that allows air permeation but does not allow ink permeation. As a result, when the sub tank 14 is opened to the atmosphere by the valve unit 15, only the air communicates between the sub tank 14 and the valve unit 15, and the ink does not leak from the sub tank 14 to the valve unit 15.

The valve unit 15 includes a larger diameter portion 15*f* provided in an upper part thereof and a ventilation hole 15*e* having a smaller diameter provided in a lower part thereof. A valve 15*b*, including a valve element having a larger diameter and a rod having a smaller diameter integrally formed with each other, is housed in the larger diameter portion 15*f* in an upwardly/downwardly movable manner. A packing 15*c* consisting of an O-ring for sealing is disposed between a lower end surface side of the valve element of the valve 15*b* and an upper end surface side of the ventilation hole 15*e*.

The valve 15*b* is constantly pressed downwardly by a spring 15*a*, such as a coil spring, provided in the larger diameter portion 15*f*. In this state, the packing 15*c* is pressed by the valve element of the valve 15*b* and a lower end surface of the larger diameter portion 15*f*, and thereby the valve 15*b* is in a valve closed state. In the valve closed state, the rod of the valve 15*b* extends to a vicinity of a lower end opening of the ventilation hole 15*e*.

When a release rod 16 provided, for example, at a waiting position of the recording head 4 moves upwardly thereby to press the rod of the valve 15*b* upwardly against a biasing force of the spring 15*a*, the valve element of the valve 15*b* departs from the packing 15*c*, and thereby the valve 15*b* is put into a valve opened state, or an open-to-atmosphere state.

The pump 12 provided halfway along the ink supply tube 11 is a pump which is capable of transferring ink bidirectionally, i.e., in a direction of supplying ink from the ink cartridge 13 to the sub tank of the recording head 4 (hereinafter referred to as the ink supply direction) and in a direction of returning ink from the sub tank 14 to the ink cartridge 13 (hereinafter referred to as the ink return direction).

Figure 4A:
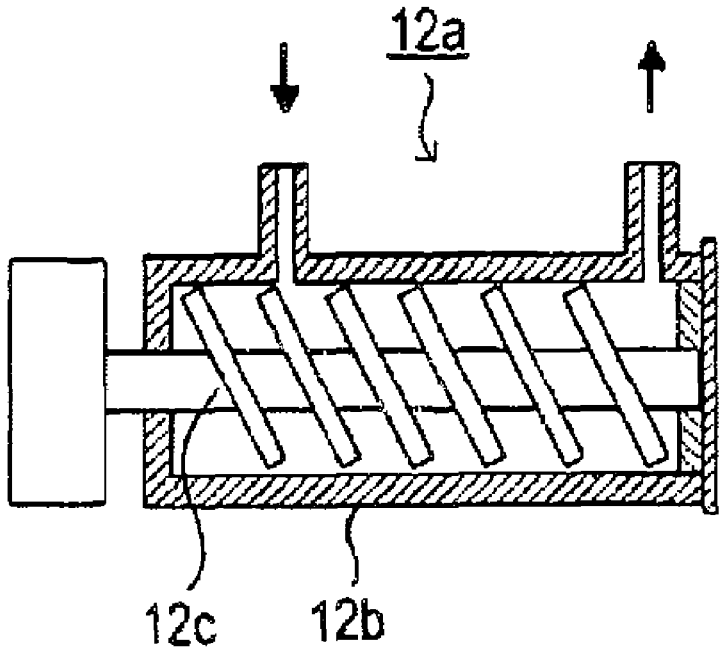
FIG. 4A is a schematic view of a screw pump.

As shown in FIG. 4A, a screw pump 12*a* functions as a pump 12 in the following manner. When a screw-shaped rotor 12*c* is rotated while contacting an internal surface of a casing 12*b*, ink which fills a space formed between a screw. thread and the internal surface of the casing 12*b* is transferred in an axial direction.

Figure 4B:
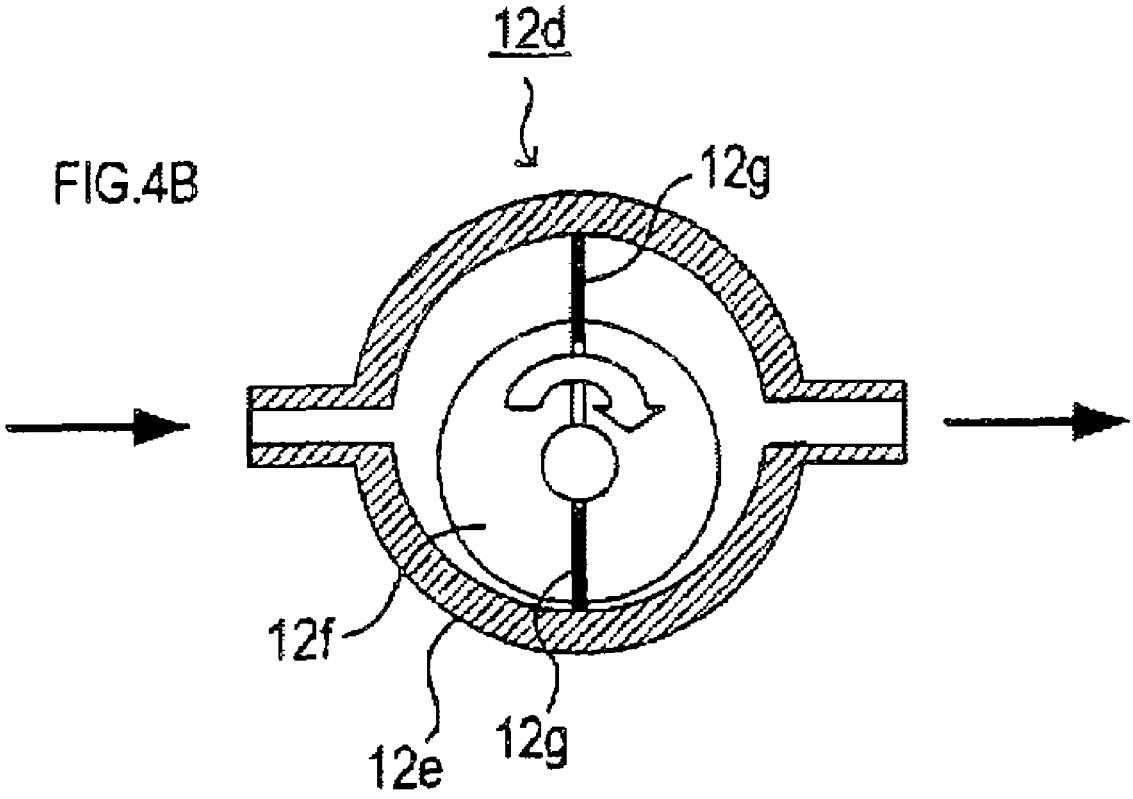
FIG. 4B is a schematic view of a vane pump.

As shown in FIG. 4B, a vane pump 12*d* is configured such that plate-like blades (vanes) 12*g* are allowed to move in and out of a groove, which is provided radially in a rotor 12*f*, in a radial direction of the rotor 12*f*. When the rotor 12*f* is rotated, the vanes 12*g* extend outwardly in the radial direction of the rotor 12*f* due to a centrifugal force. Then, respective one ends of the vanes 12*g* contact an inner circumference surface of a casing 12*e* and are moved in a sliding manner in accordance with the rotation of the rotor 12*f*. Since sizes of chambers surrounded by the vanes 12*g*, the rotor 12*f* and the casing 12*e* are increased and decreased in accordance with the rotation of the rotor 12*f*, the vane pump 12*d* functions as a pump 12.

In the inkjet recording apparatus 1 of the present embodiment, either of the screw pump 12*a* and the vane pump 12*d* may be employed as the pump 12 for transferring ink.

Figure 5A:
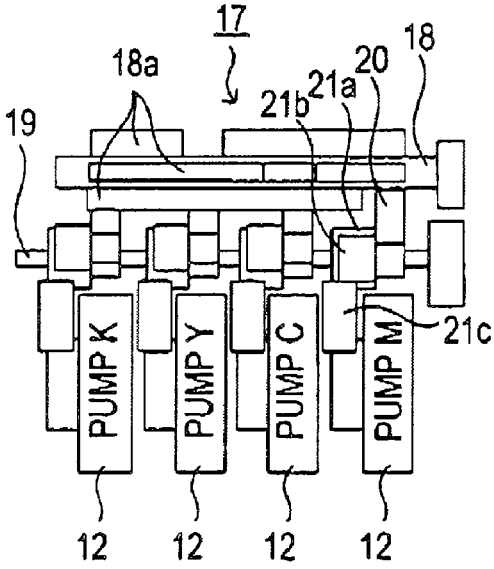
FIGS. 5A to 5C are schematic views of a pump drive switching mechanism.
Figure 5B:
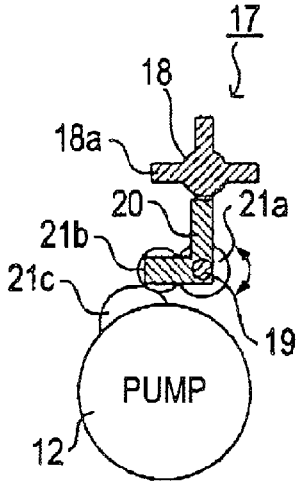
Figure 5C:
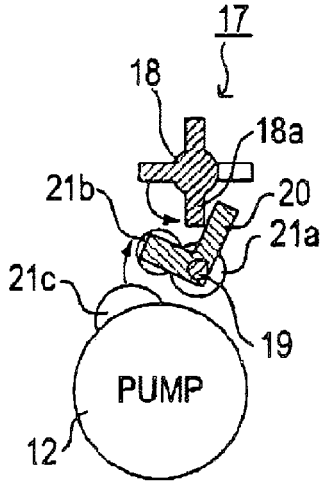

Referring to FIGS. 5A-5C, a pump drive switching mechanism 17 is designed to selectively drive the pumps 12 corresponding to respective inks of four colors of K, Y, C and M.

As shown in FIG. 5A, the pump drive switching mechanism 17 includes a drive switching gear 18, a pump drive shaft 19, a gear supporting member 20, a drive shaft gear 21*a*, an intermediate gear 21*b*, and a pump side gear 21*c*. The drive switching gear 18 performs connection switching of a driving force to the pumps 12 for the respective inks of colors of K, Y, C and M. The pump drive shaft 19 is rotated by an operation of a pump drive motor 23 (not shown in FIGS. 5A-5C; see FIG. 6). The gear supporting member 20 is supported by the pump drive shaft 19 to be rotatable around the pump drive shaft 19. The drive shaft gear 21*a* is axially penetrated by the pump drive shaft 19. The intermediate gear 21*b* is axially supported at one end of the gear supporting member 20 so as to engage with the drive shaft gear 21*a*. The pump side gear 21*c* is provided to drive the pump 12. A set of components consisting of the gear supporting member 20, the drive shaft gear 21*a*, the intermediate gear 21*b* and the pump side gear 21*c* are provided for each pump 12 for the ink of each color. The gear supporting member 20 is constantly biased toward a direction so as to engage the intermediate gear 21*b* with the pump side gear 21*c*.

Figure 6:
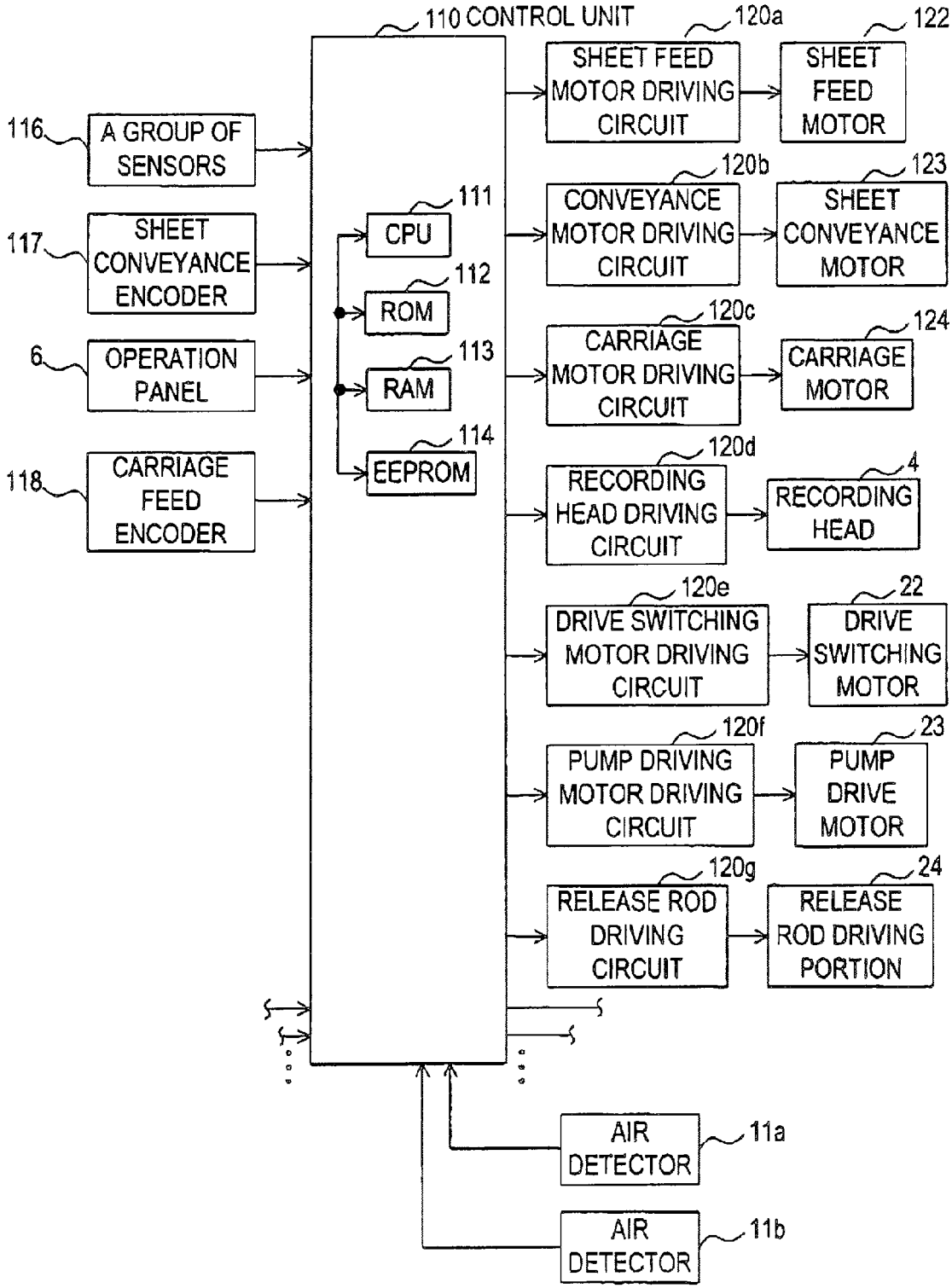
FIG. 6 is a block diagram showing an electrical configuration of the inkjet recording apparatus.

The drive switching gear 18 is designed to be rotated by an operation of a drive switching motor 22 (not shown in FIGS. 5A-5C; see FIG. 6). The drive switching gear 18 includes strip-like teeth 18*a*, which are formed at 90° intervals in four directions so as to engage with, when rotated, the other ends of the respective gear supporting members 20 disposed under the drive switching gear 18. Each of the teeth 18*a* has a notch so as not to engage with the one-to-one corresponding gear supporting member 20 at the notch. Each notch is located at a different position from the other notches. Accordingly, by rotating the drive switching gear 18 by a specified amount (90°), selection of one of the pumps 12 can be performed due to a function of the each of the teeth 18*a* provided to the drive switching gear 18 and the notch therein.

Specifically, as shown in FIG. 5B, when a notch of one of the teeth 18*a* is located in a lower position, the gear supporting member 20 corresponding to the notch presses the intermediate gear 21*b* against the pump side gear 21*c*, and thereby the intermediate gear 21*b* engages with the pump side gear 21*c*. Accordingly, the drive shaft gear 21*a*, the intermediate gear 21*b* and the pump side gear 21*c* engage one another. In this state, the rotation of the pump drive shaft 19 driven by the pump drive motor 23 is transmitted to the pump side gear 21*c* through the drive shaft gear 21*a*, which is axially penetrated by the pump drive shaft 19, and the intermediate gear 21*b*. Then, the rotation of the pump side gear 21*c* drives the pump 12.

FIG. 5C shows a state in which the drive switching gear 18 is rotated by 90° in a counterclockwise direction from a state shown in FIG. 5B. When one of the teeth 18*a* is rotated to a lower position and engages with the other end of the gear supporting member 20, the gear supporting member 20 is rotated around the pump drive shaft 19 against a biasing force (in a clockwise direction in FIG. 5C). As a result, engagement between the intermediate gear 21*b* axially supported by the one end of the gear supporting member 20 and the pump side gear 21*c* is released. In this states the rotation of the pump drive shaft 19 is not transmitted to the pump side gear 21*c*, and thus the pump 12 is not driven.

In the pump drive switching mechanism 17, it is possible to switch the rotation direction of the pump drive motor 23 between a forward direction and a reverse direction thereby to drive each of the pumps 12 in either of the forward direction and the reverse direction. Thus, bidirectional transfer of ink, i.e., in the ink supply direction and in the ink return direction, may be performed.

Electrical Structure of the Inkjet Recording Apparatus 1

As shown in FIG. 6. the inkjet recording apparatus 1 includes a control unit 110 having a CPU 111, a ROM 112, a RAM 113 and an EEPROM 114.

The control unit 110 is electrically connected to a group of sensors 116, a sheet conveyance encoder 117, an operation panel 6 and a carriage feed encoder 118. The group of sensors 116 include a known media sensor or a known regist sensor capable of detecting presence/absence of the recording sheet 40, a front sheet edge, a rear sheet edge or a width direction sheet edge of the recording sheet 40. The sheet conveyance encoder 117 detects a conveyance amount (or a position) of the recording sheet 40.

The control unit 110 is also electrically connected to a sheet feed motor driving circuit 120*a* for driving a sheet feed motor 122, a conveyance motor driving circuit 120*b* for driving the sheet conveyance motor 123, a carriage motor driving circuit 120*c* for driving a carriage motor 124, a recording head driving circuit 120*d* for driving the recording head 4 (i.e., discharging ink), a drive switching motor driving circuit 120*e* for driving the drive switching motor 22, a pump drive motor driving circuit 120*f* for driving the pump drive motor 23 and a release rod driving circuit 120*g* for driving a release rod driving portion 24.

The CPU 111 controls these driving circuits 120*a*-120*g* according to a variety of programs stored in the ROM 112 or the EEPROM 114 thereby to drive and control the respective objects to be driven. As described above, the sheet feed roller 8 is driven by a rotation of the sheet feed motor 122, while the conveyer roller 7*a* is driven by a rotation of the sheet conveyance motor 123.

The control unit 110 is further electrically connected to the air detector 11*a* and the air detector 11*b* for each of the ink supply tubes 11.

The RAM 113 of the control unit 110 stores an initial dimension corresponding value that is an initial value of a dimension corresponding value for each of the ink supply tubes 11. The dimension corresponding value here means a value which can be obtained from a dimension of the ink supply tube 11 (specifically, a dimension of the ink supply tube 11 in a portion from the first detection position to the second detection position). For example, an inner diameter, a length, an inner volume, or a flow path resistance (a pressure loss) of the ink supply tube 11 may be the dimension corresponding value.

The dimension corresponding values may be in various forms as above. In the present embodiment, explanations are provided hereinafter in two cases where two types of values (1) and (2) are employed as the dimension corresponding values, respectively.

(1) An inner diameter of each of the ink supply tubes 11 in a portion from the first detection position to the second detection position (hereinafter also simply referred to as the "inner diameter of each of the ink supply tubes 11", the "inner diameter of the ink supply tube 11", or a "dimension corresponding value 1").

(2) A flow path resistance (a pressure loss) when ink flows in each of the ink supply tubes 11 in a portion from the first detection position to the second detection position (hereinafter also simply referred to as the "flow path resistance in each of the ink supply tubes 11", the "flow path resistance in the ink supply tube 11", or a "dimension corresponding value 2").

The initial dimension corresponding value, which is an initial value of a dimension corresponding value, specifically may be, for example, a dimension corresponding value as originally designed, or a dimension corresponding value actually measured while manufacturing the inkjet recording apparatus 1.

Explanations will be provided below in a case where an originally designed value of the "inner diameter of each of the ink supply tubes 11" is stored in the RAM 113 as the initial dimension corresponding value, and in a case where an originally designed value of the "flow path resistance in each of the ink supply tubes 11" is stored in the RAM 113 as the initial dimension corresponding value. Hereinafter, an initial dimension corresponding value regarding the "inner diameter of each of the ink supply tubes 11" is also referred to as an "initial dimension corresponding value 1", while an initial dimension corresponding value regarding the "flow path resistance in each of the ink supply tubes 11" is also referred to as an "initial dimension corresponding value 2".

The RAM 113 also stores a table indicating a correspondence between the "inner diameter of each of the ink supply tubes 11" and a pump liquid-transfer amount (see FIG. 9).

The pump liquid-transfer amount here means a transfer amount for discard by the pump 12, which is to be discarded at the time of an initial operation and at predetermined intervals starting from the time of the initial operation, of the mixture of the ink and air existing at least in each of the ink supply tubes 11 (in each of the ink supply tubes 11 and in the recording head 4 (in the sub tank 14) connected to the each of the ink supply tubes 11 in the present embodiment). Such a discard may preferably prevent the ink with an increased viscosity from remaining in each of the ink supply tubes 11. "The time of the initial operation" means a time when the user turns on a power of the inkjet recording apparatus 1 for the first time.

The RAM 113 further stores a table indicating a correspondence between the "flow path resistance in each of the ink supply tubes 11" and a pump liquid-transfer pressure (see FIG. 10).

The pump liquid-transfer pressure here means a pressure to be applied by the pump 12 to the ink (specifically the mixture of the ink and air) existing in each of the ink supply tubes 11 when a purge operation is performed to recover the discharge ability of the ejection nozzle 14*a* included in the recording head 4, which is connected with the ink supply tube 11, in accordance with the user's operation of the operation panel 6.

The RAM 113 is also used to store a measured ink discharge amount. Measurement of the ink discharge amount is performed by executing a counting process (later described S320-S340, S370-380 (FIG. 8)) each time ink is discharged from each of the ejection nozzles 14*a*.

In the counting process, a counted value to be stored in the RAM 113 is increased by a specified value (for example "1") each time a predetermined amount of ink is discharged. The counted value to be increased at one time is changed depending on a size of a discharged ink droplet.

For example, when an ink droplet with a relatively small size is discharged once, the counted value is increased by 1, while when an ink droplet with a relatively large size is discharged once, the counted value is increased by 3.

Also in the counting process, the counted value is increased by a specified value (for example "50"), for example, a purge operation to recover the discharge ability of the ejection nozzle 14*a* (a discharge ability recovery process) is performed in accordance with the user's operation of the operation panel 6.

The RAM 113 further stores an ink discharge amount per 1 counted value (hereinafter also simply referred to as a "unit discharge amount"). The unit discharge amount is used to convert a counted value when counting is stopped (aftermentioned S340 (FIG. 8)) into an ink amount (hereinafter simply referred to as an "ink transfer amount") discharged from each ejection nozzle 14*a* corresponding to each of the ink supply tubes 11 while the air moves from the first detection position to the second detection position of the ink supply tube 11.

"The ink transfer amount" is, in other words, a transfer amount of the mixture of the ink and the air to be transferred through each of the ink supply tubes 11 while the air moves from the first detection position to the second detection position of the ink supply tube 11.

The control unit 110 also performs "an ink replacement process" to replace ink in each of the ink supply tubes 11 and the recording head 4 (in the sub tank 14) which is connected to the each of the ink supply tubes 11, and "a tube rank detection process" (described in detail later) to detect and store rank data regarding each of the ink supply tubes 11.

Explanation of Ink Replacement Process

Figure 7A:
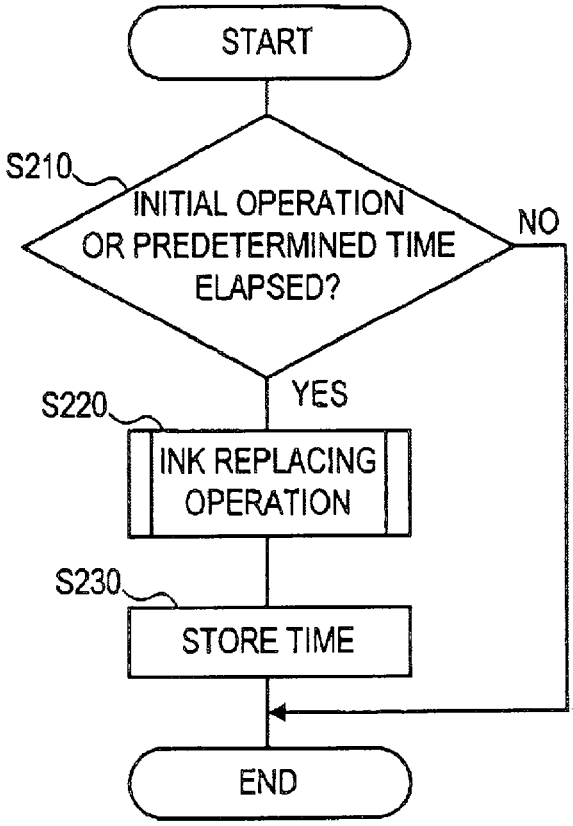
FIGS. 7A and 7B are flowcharts illustrating a procedure of an ink replacement process.
Figure 7B:
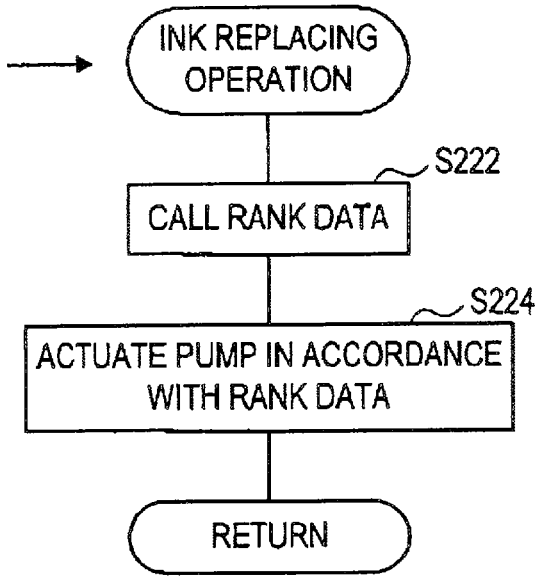

The ink replacement process performed by the control unit 110 will now be described with reference to the flowchart in FIGS. 7A and 7B. The ink replacement process to replace ink in the ink supply tube 11 and the recording head 4 is repeatedly performed while the power of the inkjet recording apparatus 1 is on, in order to preferably prevent the ink with an increased viscosity from remaining in each of the ink supply tubes 11.

First, it is determined whether or not this is the time of an initial operation, or whether or not a predetermined time period has elapsed since an ink replacing operation as a sub routine of the present process is performed last time (S210). It is preferable to set the predetermined time period to 20 to 30 days considering a thickening property of ink in the ink supply tube 11 and the recording head 4. The predetermined time period in the present embodiment is set to 20 days.

When it is determined that this is not the time of an initial operation, or that the predetermined time period has not elapsed (S210: N), the present process is terminated. When it is determined that this is the time of an initial operation, or that the predetermined time period has elapsed (S210: Y), the ink replacing operation as a sub-routine (S220) is performed. Then, a time at which the ink replacing operation is performed is stored (S230) in the RAM 113 or the like, and the present process is terminated.

Figure 8:
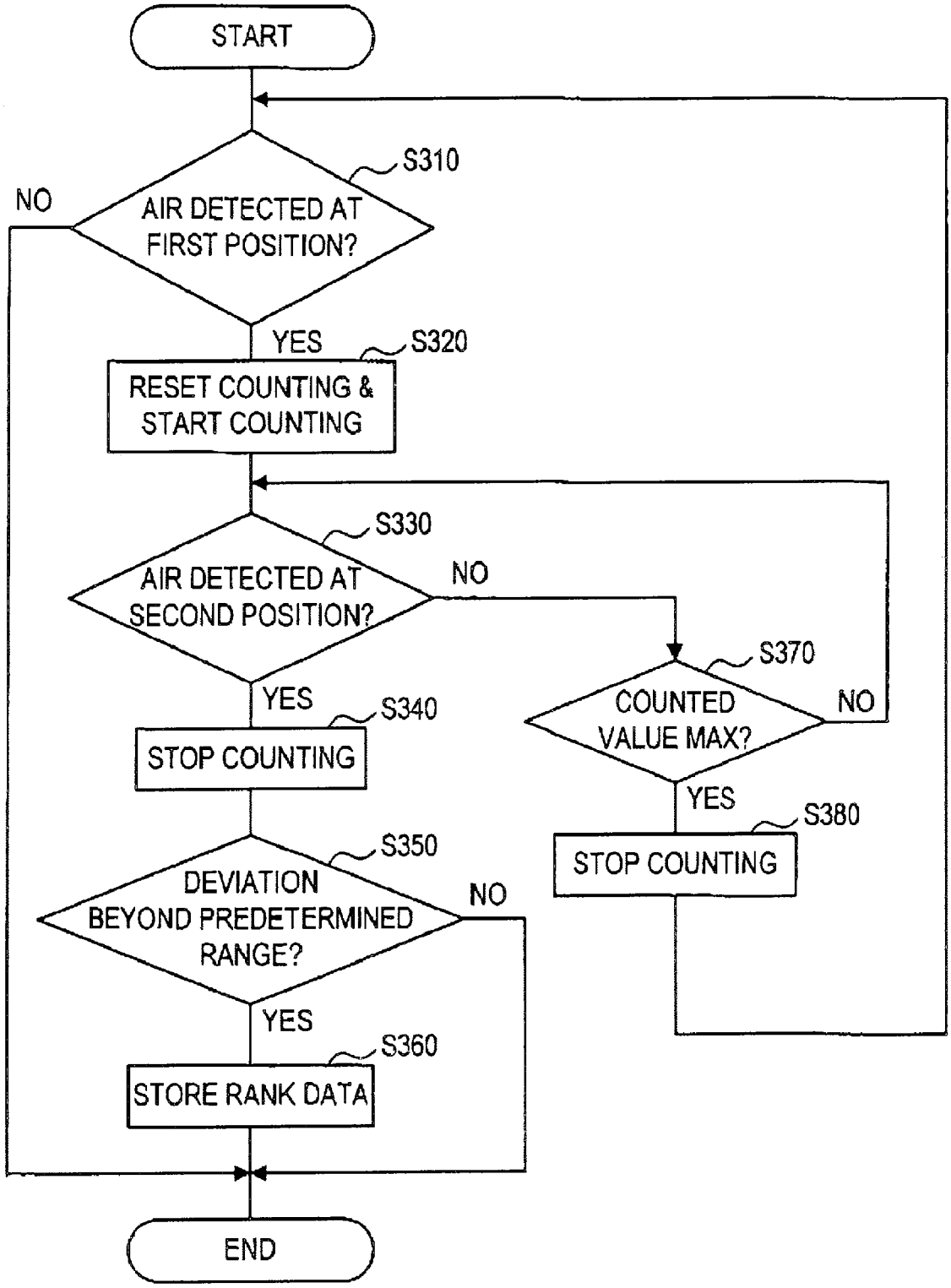
FIG. 8 is a flowchart illustrating a procedure of tube rank detection process.

The ink replacing operation as the sub-routine (S220) will now be described. First, rank data (the pump liquid-transfer amount (see FIG. 9)) corresponding to each of the ink supply tubes 11 is called from the RAM 113 (S222), and each of the pumps 12 is actuated in accordance with the called rank data (S224). That is, each of the pumps 12 is actuated so as to discharge ink (specifically the mixture of ink and air) in a pump liquid-transfer amount determined based on the inner diameter of each of the ink supply tubes 11 in the processings of the later described S340-S360 (FIG. 8). Then, the present process returns. The rank data (the pump liquid-transfer amount) is stored in the RAM 113 by a later-described tube rank detection process.

Explanation of Tube Rank Detection Process

The tube rank detection process performed by the control unit 110 will now be described with reference to the flowchart in FIG. 8, FIG. 9 and FIG. 10. FIG. 8 is a flowchart showing a procedure of the tube rank detection process executed by the controller 110 with respect to each of the ink supply tubes 11. FIG. 9 is an explanatory view showing a corresponding setting rank table indicating a correspondence between the inner diameter of the ink supply tube 11 and the pump liquid-transfer amount. FIG. 10 is an explanatory view showing a corresponding setting rank table indicating a correspondence between the flow path resistance in the ink supply tube 11 and the pump liquid-transfer pressure.

The tube rank detection process is a process in which detection of two types of rank data (the pump liquid-transfer amount (see FIG. 9) and the pump liquid-transfer pressure (see FIG. 10)) corresponding to each of the ink supply tubes 11 is performed by detecting the inner diameter of the each of the ink supply tubes 11. The tube rank detection process is repeatedly performed while the power of the inkjet recording apparatus 1 is on. The tube rank detection process is performed with respect to each of the ink supply tubes 11 provided correspondingly to each of the four recording heads 4.

First, it is determined whether or not air is detected at the first detection position based on an output signal from the air detector 11*a* (S310). When it is determined that air is not detected at the first detection position (S310: N), the present process is terminated. When it is determined that air is detected at the first detection position (S310: Y), a counted value to be used for a courting process is reset and the counting process is started (S320).

Subsequently, it is determined whether or not air is detected at the second detection position based on an output signal from the air detector 11*b* (S330). When it is determined that air is not detected at the second detection position (S330: N), it is then determined whether or not the counted value by the measurement of the ink discharge amount has reached a MAX value (S370).

When it is determined that the counted value has not reached the MAX value (S370: N), the present process returns to S330. When it is determined that the counted value has reached the MAX value (S370: Y), counting is stopped and the present process returns to S310 (S370: Y, S380). The MAX value here means a maximum value of the counted value to be counted in the counting process while air moves from the first detection position to the second detection position. In other words, if air is not detected at the second detection position even when the MAX value is counted, the air is regarded as not air which moves in the ink supply tube 11 due to a consumption of the ink (i.e., an ink transfer to outside of the ink supply tube 11 resulting from an ink discharge), and the counting process is stopped.

When it is determined that air is detected at the second detection position (S330: Y), the counting process is stopped (S340).

In S340, an ink transfer amount is determined based on a counted value when the counting process is stopped and the unit discharge amount stored in the RAM 113. Then, an inner diameter of the ink supply tube 11 and a flow path resistance in the ink supply tube 11 are determined based on the ink transfer amount, and are stored in the RAM 113.

The ink transfer amount determined as above corresponds to an inside volume of a portion of the ink supply tube 11 between the first detection position and the second detection position (hereinafter also simply referred to as the "volume of the ink supply tube 11") .

In the present embodiment, a length of a portion of the ink supply tube 11 between the first detection position and the second detection position (hereinafter also simply referred to as the "length of the ink supply tube 11") and a surface roughness of an internal wall surface of a portion of the ink supply tube 11 between the first detection position and the second detection position (hereinafter also simply referred to as the "tube roughness") are assumed to be predetermined same values, respectively, regardless of differences of the ink supply tube 11.

Accordingly, it is possible in S340 to determine the inner diameter of the ink supply tube 11 from the ink transfer amount corresponding to the volume of the ink supply tube 11. It is also possible in S340 to determine the flow path resistance in the ink supply tube 11 from the inner diameter of the ink supply tube 11.

Subsequently in S350, it is determined whether or not a deviation between the inner diameter of the ink supply tube 11 determined in S340 and a currently stored value (hereinafter also simply referred to as the "stored value 1") regarding the inner diameter of the ink supply tube 11 is beyond a predetermined range.

In the present embodiment, the stored value 1, which is previously stored in the RAM 113, may be in the following three specific forms.

(1) An initial dimension corresponding value 1 (a designed value of "the inner diameter of the ink supply tube 11" in the present embodiment).

The initial dimension corresponding value 1 is used as the stored value 1 when a first tube rank detection process is performed after the initial operation.

(2) An average value of at least one dimension corresponding value 1 (at least one value of "the inner diameter of the ink supply tube 11" determined and stored by performing the processing in S340 at least once in the present embodiment) and the initial dimension corresponding value 1.

When a second or later tube rank detection process is performed and also the number of the dimension corresponding value 1 stored in the RAM 113 is one or more but less than a predetermined number of two or more (for example, three), an average value of the at least one dimension corresponding value 1 and the initial dimension corresponding value 1 is used as the stored value 1.

(3) An average value of a predetermined number of the dimension corresponding values 1 determined and stored by repeatedly performing the processing in S340.

When the number of the dimension corresponding values 1 stored in the RAM 113 is relatively large, an average value of a predetermined number of the dimension corresponding values 1 determined and stored by a latest plurality of (for example, three) processings in S340 is used as the stored value 1.

Also in S350, it is determined whether or not a deviation between the flow path resistance in the ink supply tube 11 determined in S340 and a currently stored value (hereinafter also simply referred to as the "stored value 2") regarding the flow path resistance in the ink supply tube 11 is beyond a predetermined range.

In the present embodiment, the stored value 2, which is previously stored in the RAM 113, may be in the following three specific forms.

(1) An initial dimension corresponding value 2 (a designed value of "the flow path resistance in the ink supply tube 11" in the present embodiment).

The initial dimension corresponding value 2 is used as the stored value 2 when a first tube rank detection process is performed after the initial operation.

(2) An average value of at least one dimension corresponding value 2 (at least one value of "the flow path resistance in the ink supply tube 11" determined and stored by performing the processing in S340 at least once in the present embodiment) and the initial dimension corresponding value 2.

When a second or later tube rank detection process is performed and also the number of the dimension corresponding value 2 stored in the RAM 113 is one or more but less than a predetermined number of two or more (for example, three), an average value of the at least one dimension corresponding value 2 and the initial dimension corresponding value 2 is used as the stored value 2.

(3) An average value of a predetermined number of the dimension corresponding values 2 determined and stored by repeatedly performing the processing in S340.

When the number of the dimension corresponding values 2 stored in the RAM 113 is relatively large, an average value of a predetermined number of the dimension corresponding values 2 determined and stored by a latest plurality of (for examples three) processings in S340 is used as the stored value 2.

In S350, if it is determined that at least one of the following conditions (1) and (2) is satisfied, an affirmative determination is made (S350: Y), and the present process proceeds to S360. On the other hand, if it is determined that neither of the following conditions (1) and (2) is satisfied, a negative determination is made (S350: N), and the present process is terminated.

Condition: (1): A deviation between the inner diameter of the ink supply tube 11 determined in S340 and the stored value 1 is beyond a predetermined range.

Condition (2): A deviation between the flow path resistance in the ink supply tube 11 determined in S340 and the stored value 2 is beyond a predetermined range.

Subsequently in S360, the following proceeding is performed. Specifically, when it is determined in S350 that the above condition (1) is satisfied, one of the following processings (A) and (B) is performed.

(A) An average value of at least one dimension corresponding value 1, including the dimension corresponding value 1 stored in the RAM 113 in S340 in the present processing, and the initial dimension corresponding value 1 is determined, and the average value is stored as an updated value of the stored value 1 in the RAM 113.

The processing (A) is performed in a case where a total number of the dimension corresponding values 1 stored in the RAM 113, including the dimension corresponding value 1 stored in the RAM 113 in S340 in the present processing, is less than a predetermined number (for example three).

(B) An average value of a plurality of dimension corresponding values 1 stored in the RAM 113 by a latest plurality of (for example, three) processings in S340, including the dimension corresponding value 1 stored in the RAM 113 in S340 in the present processing, is determined, and the average value is stored as an updated value of the stored value 1 in the RAM 113.

The processing (B) is performed in a case where a total number of the dimension corresponding values 1 stored in the RAM 113 is a predetermined number (for example three) or more.

In S360, the pump liquid-transfer amount is determined from the stored value 1 (the inner diameter of the ink supply tube 11) updated by one of the processings (A) and (B) with reference to the table stored in the RAM 113 (see FIG. 9). Specifically, the pump liquid-transfer amount is determined such that following formula (1) can be established between the stored value 1 (the inner diameter of the ink supply tube 11) and the pump liquid-transfer amount.

$$An^2 \times 3.14 \text{ (the circular constant)}/Qn = \text{constant} \quad (1)$$

In the formula, "An" represents the inner diameter of the ink supply tube 11 and "Qn" represents the pump liquid-transfer amount ("n" is an integer of one or more). A control parameter of the pump liquid-transfer amount is a number of pump rotations.

In S360, the pump liquid-transfer amount determined as above is stored in the RAM 113 as the rank data to be used in the above S224.

When it is determined in S350 that the above condition (2) is satisfied, one of the following processings (C) and (D) is performed in S360.

(C) An average value of at least one dimension corresponding value 2, including the dimension corresponding value 2 stored in the RAM 113 in S340 in the present processing, and the initial dimension corresponding value 2 is determined, and the average value is stored as an updated value of the stored value 2 in the RAM 113.

The processing (C) is performed in a case where a total number of the dimension corresponding values 2 stored in RAM 113, including the dimension corresponding value 2 stored in the RAM 113 in S340 in the present processing, is less than a predetermined number (for example three).

(D) An average value of a plurality of dimension corresponding values 2 stored in the RAM 113 by a latest plurality of (for example, three) processings in S340, including the dimension corresponding value 2 stored in the RAM 113 in S340 in the present processing, is determined, and the average value is stored as an updated value of the stored value 2 in the RAM 113.

The processing (D) is performed in a case where a total number of the dimension corresponding values 2 stored in RAM 113 is a predetermined number (for example three) or more.

In S360, the pump liquid-transfer pressure is determined from the stored value 2 (the flow path resistance in the ink supply tube 11) updated by one of the processings (C) and (D) with reference to the table stored in the RAM 113 (see FIG. 10). Specifically, the pump liquid-transfer pressure is determined such that following formula (2) can be established between the stored value 2 (the flow path resistance in the ink supply tube 11) and the pump liquid-transfer pressure.

$$Hn/Pn = \text{constant} \quad (2)$$

In the formula, "Hn" represents the flow path resistance in the ink supply tube 11 and "Pn" represents the pump liquid-transfer pressure ("n" is an integer of one or more). A control parameter of the pump liquid-transfer pressure is a pump rotational speed.

In S360, the pump liquid-transfer pressure determined as above is stored in the RAM 113 as rank data. The rank data is used as data indicating a pressure to be applied to the pump 12 in the future discharge ability recovery process. That is, the pump 12 is controlled by the controller 110 so as to achieve the pump liquid-transfer pressure in the discharge ability recovery process.

[Effect]

(i) According to the inkjet recording apparatus 1 in the above-described embodiment, the dimension corresponding values 1 and 2 are determined based on the ink discharge amount (the ink transfer amount) while air moves between two detection positions. Then, the pump liquid-transfer amount in the ink replacement process and the pump liquid-transfer pressure in the discharge ability recovery process are determined.

It is, therefore, possible in the above-described embodiment to reduce an amount of ink wastefully discharged from the ejection nozzle 14*a* in the ink replacement process and in the discharge ability recovery process since the driving of the pump 12 is controlled based on the dimension corresponding values 1 and 2.

(ii) According to the inkjet recording apparatus 1 in the above-described embodiment, the first detection position is provided to the ink supply tube 11 on a side of the sub tank 14 of and in the vicinity of the pump 12. The second detection position is provided to the ink supply tube 11 in the vicinity of the sub tank 14. This results in a distance between the first detection position and the second detection position nearly the same as an actual length of the ink supply tube 11. It may, therefore, be possible to control driving of the pump 12 in accordance with the dimension corresponding values 1 and 2 of the entire ink supply tube 11 more accurately.

(iii) According to the above-described embodiment, when there are respective predetermined numbers of the dimension corresponding values 1 and 2 stored in the RAM 113, the driving of the pump 12 is controlled based on average values (updated stored values 1 and 2) of a plurality of the dimension corresponding values 1 and 2, respectively.

Compared with a case in which the driving of the pump 12 is controlled based on only one detected value regarding the dimension corresponding value 1 or only one detected value regarding the dimension corresponding value 2, the driving of the pump 12 may be controlled more accurately in accordance with the actual dimension corresponding values 1 or 2 of the ink supply tube 11.

(iv) According to the above-described embodiment, when a sufficient number of the dimension corresponding values 1 or 2 are not stored in the RAM 113, the driving of the pump 12 is controlled based on the initial dimension corresponding values 1 or 2.

Therefore, even when a sufficient number of the dimension corresponding values 1 or 2 are not stored in the RAM 113, the driving of the pump 12 is likely to be controlled relatively accurately in accordance with the actual dimension corresponding values 1 or 2 of the ink supply tube 11.

(v) Further, according to the above-described embodiment, when it is determined that the counted value in the counting process has reached the MAX value, determination of an ink transfer amount based on the counted value which has reached the MAX value is not performed. That is, an ink transfer amount based on the counted value which has reached the MAX value is excluded from the ink transfer amounts determined in S340.

Such a processing in the present embodiment is, therefore, preferable in a case in which air in the ink supply tube 11 detected in the first detection position is not air which moves in the ink supply tube 11 due to an ink transfer to outside of the ink supply tube 11. That is, it may be possible to prevent determination of an ink transfer amount erroneously based on the movement of the "air in the ink supply tube 11 detected in the first detection position".

Although one embodiment of the present invention has been described as above, the present invention should not be limited to the above-described embodiment, but may be embodied in various forms. The following description on the modifications of the above-described embodiment focuses on differences from the above-described embodiment and an explanation of the same configuration is omitted.

[Modification 1] Modifications of the Dimension Corresponding Values 1 and 2

The dimension corresponding value 1 may be a volume of the ink supply tube 11, or may be a length of the ink supply tube 11. However, the dimension corresponding value 1 may be a length of the ink supply tube 11 only when there is an assumption that an inner diameter of the ink supply tube 11 is the same regardless of differences of ink supply tubes. Also, in these cases, an initial dimension corresponding value 1 is determined as an initial value of the dimension corresponding value 1.

While the flow path resistance in the ink supply tube 11 is used as the dimension corresponding value 2 in the above-described embodiment, an inner diameter of the ink supply tube 11 may be used as the dimension corresponding value 2. Also in this case, an initial dimension corresponding value 2 is determined as an initial value of the dimension corresponding value 2.

When there is an assumption that each of the length and the tube roughness of the ink supply tube 11 is the same as a predetermined value regardless of differences of ink supply tubes, the pump liquid-transfer pressure can be determined from the inner diameter of the ink supply tube 11. In this case, the table in FIG. 10 stored in the RAM 113 is replaced by a table indicating correspondence between the inner diameter of each of the ink supply tubes 11 and the pump liquid-transfer pressure.

[Modification 2] Modification Regarding How to Determine the Pump liquid-transfer Amount The pump liquid-transfer amount may be directly determined based on the ink transfer amount determined in S340.

Specifically, an initial value of the ink transfer amount (an initial transfer amount) which is predetermined based on initial dimensions (designed dimensions or dimensions obtained by actual measurement at the time of manufacturing the inkjet recording apparatus 1) is stored in the RAM 113.

In this case, the table in FIG. 9 stored in the RAM 113 is replaced by a table indicating correspondence between the ink transfer amount of each of the ink supply tubes 11 and the pump liquid-transfer amount.

In S340, the ink transfer amount is stored in the RAM 113 instead of the inner diameter of the ink supply tubes 11.

Subsequently, in S350, it is determined whether or not a deviation between the ink transfer amount determined and stored in S340 and a currently stored value (hereinafter also simply referred to as the "stored value 3") regarding the ink transfer amount is beyond a predetermined range.

In this embodiment, the stored value 3, which is previously stored in the RAM 113, may be in the following three specific forms.

(a) An initial transfer amount

An initial transfer amount is used as the stored value 3 when a first tube rank detection process is performed after the initial operation.

(b) An average value of at least one ink transfer amount (at least one ink transfer amount determined and stored by performing the processing in S340 at least once in this embodiment) and the initial transfer amount.

When a second or later tube rank detection process is performed and also the number of the ink transfer amounts stored in the RAM 113 is one or more but less than a predetermined number of two or more (for example, three), an average value of the at least one ink transfer amount and the initial transfer amount is used as the stored value 3.

(c) An average value of a predetermined number of the ink transfer amounts determined and stored by repeatedly performing the processing in S340.

When the number of the ink transfer amounts stored in the RAM 113 is relatively large, an average value of a predetermined number of the ink transfer amounts determined and stored by a latest plurality of (for example, three) processings in S340 is used as the stored value 3.

When it is determined in S350 that a deviation between the ink transfer amount determined in S340 and the stored value 3 is beyond a predetermined range, one of the following processings (A) and (B) is performed in S360.

(A) An average value of at least one ink transfer amount, including the ink transfer amount stored in the RAM 113 in S340 in the present processing, and the initial transfer amount is determined, and the average value is stored as an updated value of the stored value 3 in the RAM 113.

The processing (A) is performed in a case where a total number of the ink transfer amounts stored in the RAM 113, including the ink transfer amount stored in the RAM 113 in S340 in the present processing, is less than a predetermined number (for example three).

(B) An average value of a plurality of ink transfer amounts stored in the RAM 113 by a latest plurality of (for example, three) processings in S340, including the ink transfer amount stored in the RAM 113 in S340 in the present processing, is determined, and the average value is stored as an updated value of the stored value 3 in the RAM 113.

The processing (B) is performed in a case where a total number of the ink transfer amounts stored in the RAM 113 is a predetermined number (for example three) or more.

In S360, the pump liquid-transfer amount is determined from the stored value 3 (the ink transfer amount) updated by one of the processings (A) and (B) with reference to the table, which indicates correspondence between the ink transfer amount of each of the ink supply tubes 11 and the pump liquid-transfer amount and is stored in the RAM 113. Specifically, the pump liquid-transfer amount is determined such that following formula (3) can be established between the stored value 3 (the ink transfer amount) and the pump liquid-transfer amount.

$$In/Qn=constant \quad (3)$$

In the formula, "In" represents the ink transfer amount and "Qn" represents the pump liquid-transfer amount ("n" is an integer of one or more).

In S360, the pump liquid-transfer amount determined as above is stored in the RAM 113 as the rank data to be used in the above S224.

In Modification 2, "the ink transfer amount determined in S340" may be replaced by, as equivalent to the ink transfer amount, a counted value itself which is obtained when the counting process is stopped in S340. Also, the initial transfer amount may be replaced by, as equivalent to the initial transfer amount, an initial value of "the counted value which is obtained when the counting process is stopped".

[Modification 3] Modification Regarding Determination of Rank Data without Determination of an Average Value In the above-described embodiment, when there are respective predetermined numbers of the dimension corresponding values 1 and 2 stored in the RAM 113, the pump liquid-transfer amount and the pump liquid-transfer pressure are determined based on average values (updated stored values 1 and 2) of a plurality of the dimension corresponding values 1 and 2, respectively.

However, it may be possible to omit the processing in S350 and determine, in S360, the pump liquid-transfer amount and the pump liquid-transfer pressure directly from one dimension corresponding value 1 and one dimension corresponding value 2, respectively, which are determined in S340.

In Modification 2, when a total number of the ink transfer amounts stored in RAM 113 is a predetermined number or more, the pump liquid-transfer amount is determined based on, an average value (an updated stored value 3) of a plurality of ink transfer amounts.

However, it may be possible to omit the processing in S350 in Modification 2 and determine, in S360, the pump liquid-transfer amount directly from one ink transfer amount, which is determined in S340.

What is claimed is:

1. An inkjet recording apparatus, comprising:

a recording head, including a sub tank for storing ink and an ejection nozzle, the recording head selectively ejecting the ink in the sub tank from the ejection nozzle to record an image on a recording medium;

a main tank that stores ink to be supplied to an inside of the sub tank;

a tube that connects the sub tank and the main tank;

a transfer device that transfers ink existing in the tube;

a transfer amount determination device that determines at least one transfer amount of a mixture of the ink and air transferred through the tube while air moves from a first detection position to a second detection position of the tube; and a driving device that controls driving of the transfer device in accordance with the at least one transfer amount determined by the transfer amount determination device.

2. The inkjet recording apparatus according to claim 1, further comprising a discharge amount measurement device that measures at least one ink amount discharged from the ejection nozzle while air moves from the first detection position to the second detection position of the tube, wherein the transfer amount determination device determines the at least one transfer amount of the mixture of the ink and air transferred through the tube while air moves from the first detection position to the second detection position of the tube, in accordance with the at least one ink amount measured by the discharge amount measurement device.

3. The inkjet recording apparatus according to claim 1, further comprising an initial amount storage device that stores an initial transfer amount which is a transfer amount of the mixture of the ink and air transferred through the tube while air moves from the first detection position to the second detection position of the tube and is predetermined in accordance with an initial dimension of the tube, wherein the transfer amount determination device determines the initial transfer amount stored by the initial amount storage device as the transfer amount to be determined by the transfer amount determination device before the transfer amount is actually determined by the transfer amount determination device, and wherein the driving device controls driving of the transfer device in accordance with the initial transfer amount.

4. The inkjet recording apparatus according to claim 1, further comprising a corresponding value determination device that determines at least one dimension corresponding value of the tube in accordance with the at least one transfer amount determined by the transfer amount determination device, wherein the driving device controls driving of the transfer device in accordance with the at least one dimension corresponding value determined by the corresponding value determination device.

5. The inkjet recording apparatus according to claim 4, further comprising:

an initial value storage device that stores an initial dimension corresponding value predetermined in accordance with an initial dimension of the tube, wherein the corresponding value determination device determines the initial dimension corresponding value stored by the initial value storage device as the dimension corresponding value to be determined by the corresponding value determination device before the at least one dimension corresponding value is actually determined by the corresponding value determination device, and wherein the driving device controls driving of the transfer device in accordance with the initial dimension corresponding value.

6. The inkjet recording apparatus according to claim 1, wherein the at least one transfer amount includes a plurality of transfer amounts repeatedly determined by the transfer amount determination device, wherein the inkjet recording apparatus further includes:

a transfer amount storage device that stores the plurality of transfer amounts; and an average value determination device that determines an average value of at least two of the plurality of transfer amounts stored by the transfer amount storage device, and wherein the driving device controls driving of the transfer device in accordance with the average value determined by the average value determination device.

7. The inkjet recording apparatus according to claim 6, further comprising an initial amount storage device that stores an initial transfer amount predetermined in accordance with an initial dimension of the tube as a transfer amount of the mixture of the ink and air transferred through the tube while air moves from the first detection position to the second detection position of the tube, wherein the average value determination device determines an average value of the at least one transfer amount stored by the transfer amount storage device and the initial transfer amount stored by the initial amount storage device when a number of the plurality of transfer amounts stored by the transfer amount storage device is one or more and less than a predetermined number of two or more, and wherein the driving device controls driving of the transfer device in accordance with the average value.

8. The inkjet recording apparatus according to claim 6, further comprising:

an average value storage device that stores the average value determined by the average value determination device; and a deviation determination device that determines, when a latest one of the transfer amounts is determined by the transfer amount determination device and the transfer amount storage device stores the latest one of the transfer amounts, whether or not a deviation between the latest one of the transfer amounts and the average value stored by the average value storage device is beyond a predetermined range, wherein when it is determined by the deviation determination device that the deviation is beyond the predetermined range, the average value determination device determines an average value of at least two of the transfer amounts, including the latest one of the transfer amounts stored by the transfer amount storage device, and the average value storage device stores the determined average value as an updated value of the average value stored by the average value storage device, and wherein when it is determined by the deviation determination device that the deviation is not beyond the predetermined range, the average value determination device determines the average value currently stored by the average value storage device as the average value to be used by the driving device to control the transfer device.

9. The inkjet recording apparatus according to claim 1, wherein the at least one transfer amount includes a plurality of transfer amounts repeatedly determined by the transfer amount determination device, wherein the inkjet recording apparatus further includes:

a corresponding value determination device that determines a plurality of dimension corresponding values of the tube in accordance with the plurality of transfer amounts;

a corresponding value storage device that stores the plurality of dimension corresponding values determined by the corresponding value determination device; and an average value determination device that determines an average value of at least two of the plurality of dimension corresponding values stored by the corresponding value storage device, and wherein the driving device controls driving of the transfer device in accordance with the average value determined by the average value determination device.

10. The inkjet recording apparatus according to claim 9, further comprising:

an initial value storage device that stores an initial dimension corresponding value predetermined in accordance with an initial dimension of the tube, wherein the average value determination device determines an average value of the at least one dimension corresponding value stored by the corresponding value storage device and the initial dimension corresponding value stored by the initial value storage device when a number of the dimension corresponding values stored by the corresponding value storage device is one or more and less than a predetermined number of two or more, and wherein the driving device controls driving of the transfer device in accordance with the average value.

11. The inkjet recording apparatus according to claim 9, further comprising:

an average value storage device that stores the average value determined by the average value determination device; and a deviation determination device that determines, when a latest one of the dimension corresponding values is determined by the corresponding value determination device and the corresponding value storage device stores the latest one of the corresponding values, whether or not a deviation between the latest one of the dimension corresponding values and the average value stored by the average value storage device is beyond a predetermined range, wherein when it is determined by the deviation determination device that the deviation is beyond the predetermined range, the average value determination device determines an average value of at least two of the dimension corresponding values, including the latest one of the dimension corresponding values stored by the corresponding value storage device, and the average value storage device stores the determined average value as an updated value of the average value stored by the average value storage device, and wherein when it is determined by the deviation determination device that the deviation is not beyond the predetermined range, the average value determination device determines the average value currently stored by the average value storage device as the average value to be used by the driving device to control the transfer device.

12. The inkjet recording apparatus according to claim 1, wherein the driving device determines a discarding transfer amount of the mixture of the ink and the air existing at least in the tube in accordance with the at least one transfer amount determined by the transfer amount determination device, and controls driving of the transfer device such that the mixture of the discarding transfer amount is discarded from at least inside of the tube.

13. The inkjet recording apparatus according to claim 6, wherein the driving device determines a discarding transfer amount of the mixture of the ink and the air existing at least in the tube in accordance with the average value determined by the average value determination device, and controls driving of the transfer device such that the mixture of the discarding transfer amount is discarded from at least inside of the tube.

14. The inkjet recording apparatus according to claim 9, wherein the driving device determines a discarding transfer amount of the mixture of the ink and the air existing at least in the tube in accordance with the average value determined by the average value determination device, and controls driving of the transfer device such that the mixture of the discarding transfer amount is discarded from at least inside of the tube.

15. The inkjet recording apparatus according to claim 4, wherein the driving device determines a discarding transfer amount of the mixture of the ink and the air existing at least in the tube in accordance with the dimension corresponding value determined by the corresponding value determination device, and controls driving of the transfer device such that the mixture of the discarding transfer amount is discarded from at least inside of the tube.

16. The inkjet recording apparatus according to claim 4, wherein the dimension corresponding value is one of an inner diameter in a portion of the tube from the first detection position to the second detection position, and a flow path resistance when the ink flows in the portion of the tube from the first detection position to the second detection position, and wherein the driving device determines a pressure to be applied to the ink existing in the tube in order to recover a discharge ability of the ejection nozzle in accordance with the dimension corresponding value determined by the corresponding value determination device, and controls driving of the transfer device in accordance with the pressure.

17. The inkjet recording apparatus according to claim 9, wherein the dimension corresponding value is one of an inner diameter in a portion of the tube from the first detection position to the second detection position, and a flow path resistance when the ink flows in the portion of the tube from the first detection position to the second detection position, and wherein the driving device determines a pressure to be applied to the ink existing in the tube in order to recover a discharge ability of the ejection nozzle in accordance with the average value determined by the average value determination device, and controls driving of the transfer device in accordance with the pressure.

18. The inkjet recording apparatus according to claim 1, further comprising:

a determination device that determines whether or not the transfer amount of the mixture of the ink and air transferred through the tube exceeds a predetermined amount before the air moves from the first detection position to the second detection position of the tube;

wherein when it is determined that the transfer amount of the mixture of the ink and air transferred through the tube exceeds the predetermined amount before the air moves from the first detection position to the second detection position of the tube, the transfer amount determination device excludes the transfer amount exceeding the predetermined amount from the at least one transfer amount to be determined by the transfer amount determination device.

19. The inkjet recording apparatus according to claim 1, wherein the first detection position is provided in a vicinity of an end of the tube on a side of the main tank, and the second detection position is provided in a vicinity of an end of the tube on a side of the sub tank.

* * * * *